US007093333B2

(12) United States Patent
Lee

(10) Patent No.: US 7,093,333 B2
(45) Date of Patent: Aug. 22, 2006

(54) FABRIC CONVEYING GUIDE RAIL

(76) Inventor: Chun Chang Lee, PO Box 82-144, Taipei (TW)

( * ) Notice: Subject to any disclaimer, the term of this patent is extended or adjusted under 35 U.S.C. 154(b) by 295 days.

(21) Appl. No.: 10/832,320

(22) Filed: Apr. 27, 2004

(65) Prior Publication Data

US 2005/0236456 A1 Oct. 27, 2005

(51) Int. Cl.
*D06C 3/02* (2006.01)

(52) U.S. Cl. ..... 26/91; 26/89

(58) Field of Classification Search ..... 26/91, 26/89, 93, 96, 87, 88, 98, 72, 73, 76, 52, 26/53, 51.3; 226/170, 173, 174
See application file for complete search history.

(56) References Cited

U.S. PATENT DOCUMENTS

| | | | | | |
|---|---|---|---|---|---|
| 638,306 | A * | 12/1899 | Winsor | ..... | 26/53 |
| 742,107 | A * | 10/1903 | Whitley | ..... | 26/53 |
| 763,415 | A * | 6/1904 | McLean | ..... | 26/53 |
| 1,746,473 | A * | 2/1930 | Hoey | ..... | 26/52 |
| 3,529,332 | A * | 9/1970 | Hyatt | ..... | 26/91 |
| 3,571,846 | A * | 3/1971 | Tomlinson | ..... | 26/91 |
| 3,598,371 | A * | 8/1971 | Hyatt | ..... | 26/91 |
| 3,727,273 | A * | 4/1973 | Hyatt et al. | ..... | 26/91 |
| 4,080,692 | A * | 3/1978 | Parrillo et al. | ..... | 26/91 |
| 4,103,403 | A * | 8/1978 | Parrillo et al. | ..... | 26/91 |

* cited by examiner

*Primary Examiner*—Amy B. Vanatta
(74) *Attorney, Agent, or Firm*—Leong C. Lei

(57) ABSTRACT

A fabric conveying guide rail has a G-shaped saddle locked to where below a conveying guide rail; screw holes being laterally drilled on both outer walls of the recess formed to the web of the saddle; a sleeve being positioned with tabs and slots of a setting nut to lock up the saddle; a guide screw being screwed into the nut; two saddles being mounted in symmetry on a laterally structured square tube; the setting nut being locked horizontally to the recess to define a space between the saddle and the top of the setting nut for insertion of a separation plate that is moved by adjusting the width of the guide screw to prevent the fabric from being contaminated by the guide screw.

1 Claim, 6 Drawing Sheets

FABRIC CONVEYING GUIDE RAIL

BACKGROUND OF THE INVENTION (a) Technical Field of the Invention

The present invention is related to a fabric conveying guide rail, and more particularly, to one that prevents the fabric from being contaminated when the fabric drops to contact threads by providing a separation plate in the space between saddle and the top of a guide screw.

(b) Description of the Prior Art

In the structure of a stenter used in dyeing and bleaching of fabric, two guide rails to convey the fabric on both sides are adjusted for its width to compromise that of the fabric with the RH and LH threads in a saddle mounted below the guide rail so to drag and pull the fabric by its edges for processing. Referring to FIGS. 1, 2, and 3 of the accompanying drawings, the structure of an earlier version of the stenter is characterized in that a saddle 200 is locked to where below a guide rail 100 to convey a fabric; a recess 201 is reserved to the web of the saddle 200; both of the upper and the lower sides of the outer wall of the recess 201 are each vertically drilled a screw hole 202; a setting nut 300 provided on its both sides a tab 301 and 1 slot 302 to hold a sleeve 400 in place to lock up the saddle 200; a guide screw 500 is provided in the setting nut 300; and two saddles 200 in symmetry are mounted to a laterally structured square tube 600. Whereas the setting nut 300 is vertically provided in the recess 201 of the saddle 200, there is no space existing between the saddle 200 and the setting screw 300 to expose the LH and RH threaded guide screws. Meanwhile, the lubricant applied to the guide screws for the adjustment of the guide rail causes the traveling fabric 700 to be contaminated by the guide screws whenever the fabric 700 drops.

An improved structure as taught in Taiwan Patent Gazette Publication No. 547511 titled "Fabric Contamination-Proof Installation for Mobile Guide Screw of Fabric Conveying Guide Rail", it is characterized in that a mobile lid is provided above the mobile guide screw adapted with a dialing plate that moves laterally and is provided on both of its outer sides each a push-pull inclined member; once the dialing plate moves towards the lid, the lid gradually flaps outwardly due to the push and pull by the dialing plate to facilitate the fabric to stride over the conveying guide rail; on the contrary, when the dialing plate gradually moves away from the lid, the lid returns to its original place to cover up the moving guide screw to prevent the fabric from being contaminated by the moving guide screw.

However, the RH and LH threaded guide screws can only be allowed to move for the saddle to adjust the width of the conveying guide rails by flapping out the lid to duck away from a mobile seat. Though the operation of the mechanism is not yet termed as difficult, the adaptation of a return spring and a limit installation to the lid adds more difficulties in the assembly.

SUMMARY OF THE INVENTION

The primary purpose of the present invention is to provide an improved structure of a fabric conveying guide rail that effectively prevents the fabric from being contaminated by the underlying guide screws during the course of conveying. To achieve the purpose, majority of the those components of a resin stenter in the process of fabric dyeing and bleaching are reserved, and two saddles each in G-shape are provided for both RH and LH threaded guide screws that are used to adjust the width of the conveying rails. The setting screw is provided in lateral position, instead of vertical position found in the prior art so to define a space between the top of the guide screw and the saddle for insertion of a separation plate to force the fabric not to contact the guide screw. Wherein, a recess is provided to the web of the saddle and a screw hole is each drilled laterally into both outer sides of the recess. A sleeve held in position by tabs and slots of a setting nut is used to lock up the saddle. A guide screw is provided in the setting nut. Two saddles in symmetry are mounted to a laterally structured square tube and the setting screw is locked horizontally to the recess of the saddle to define a space between the saddle and the top of the setting nut for the insertion of a separation plate locked to the outer wall of the recess. With the space reserved to the saddle for the guide screw to adjust the width between two saddles to move the separation plate, the mobile lid is not required.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
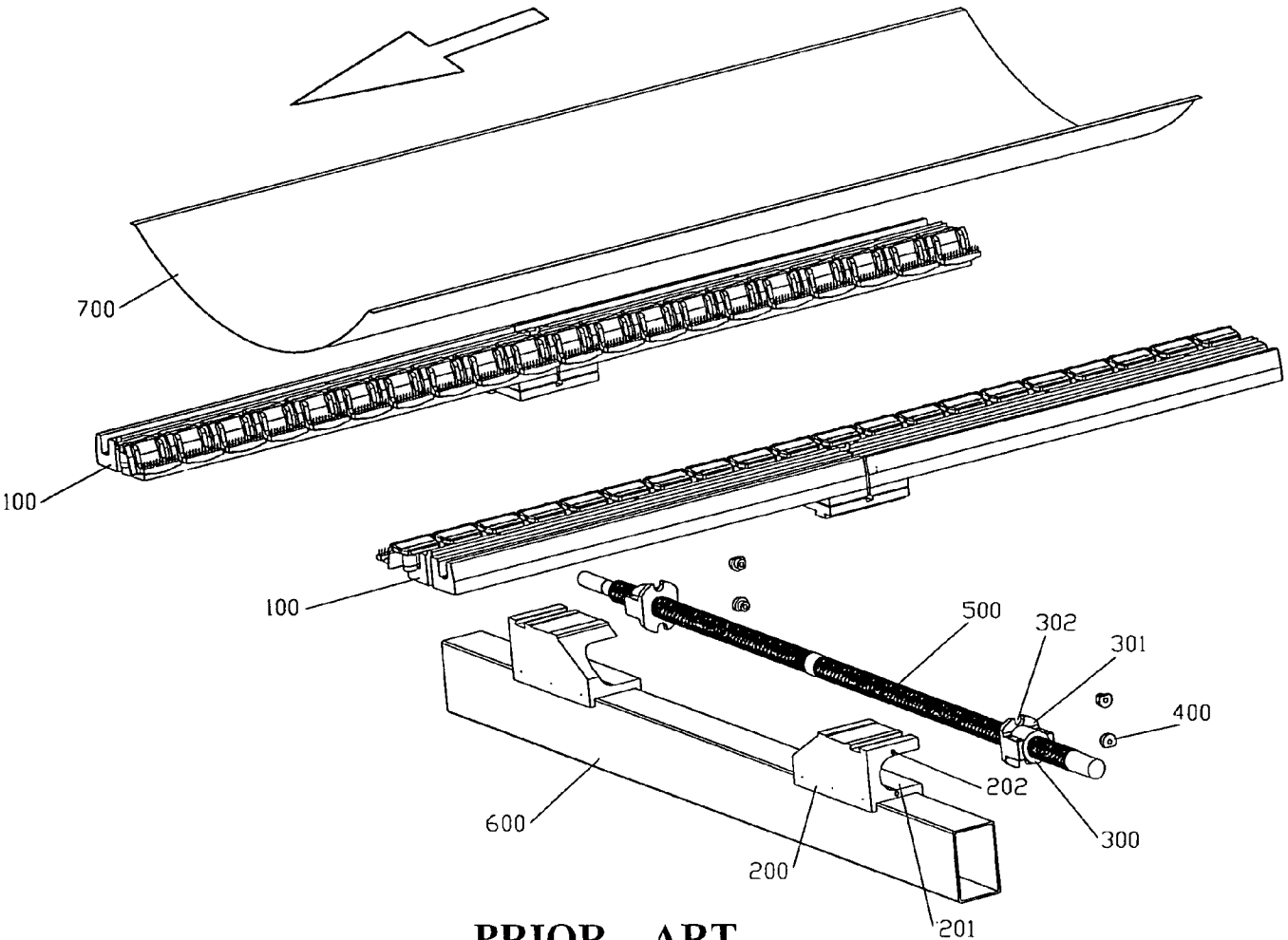
PRIOR ART FIG. 1
FIG. 1 is an exploded view of the prior art.
Figure 2:
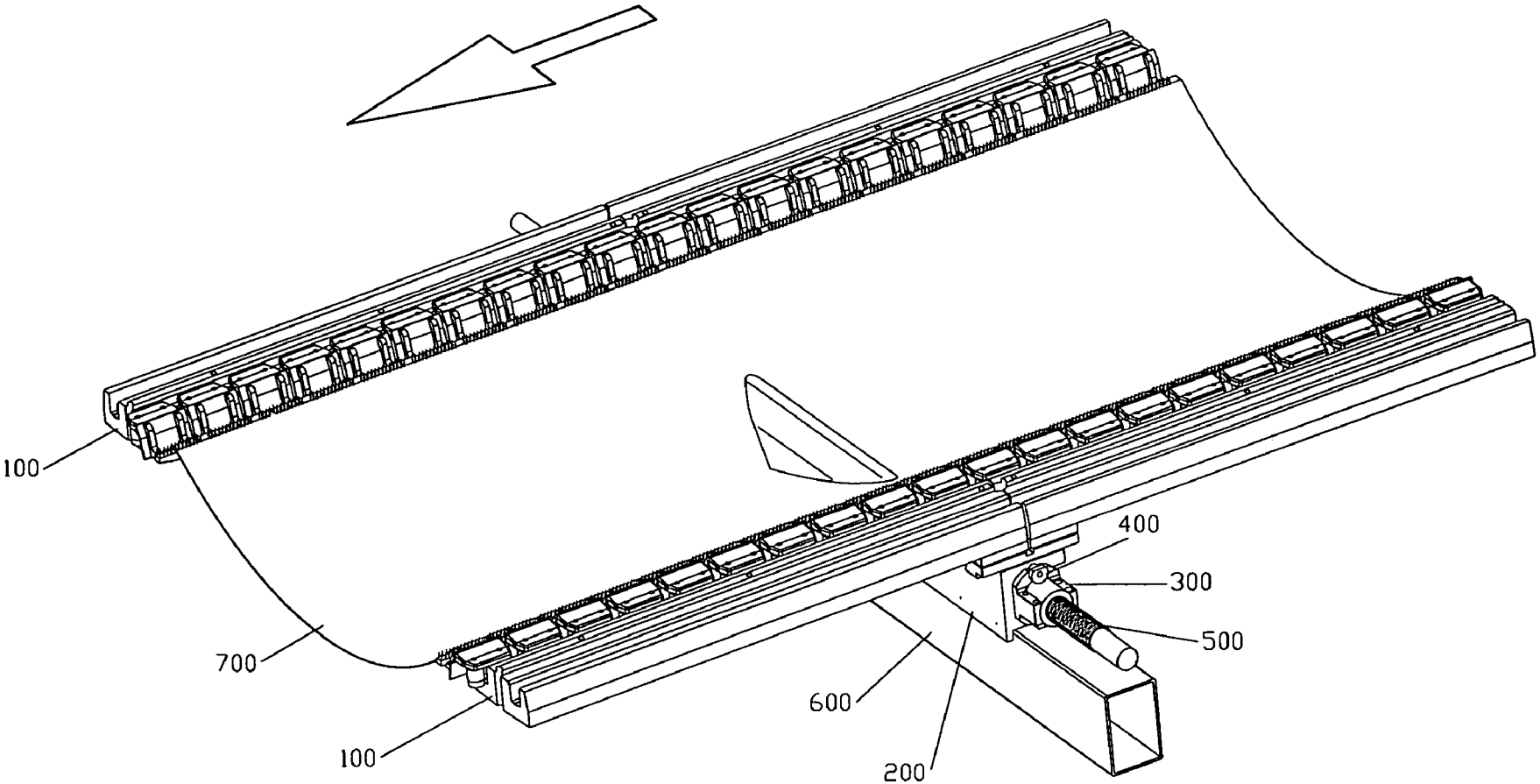
PRIOR ART FIG. 2
FIG. 2 is a schematic view of the prior art as assembled.
Figure 3B:
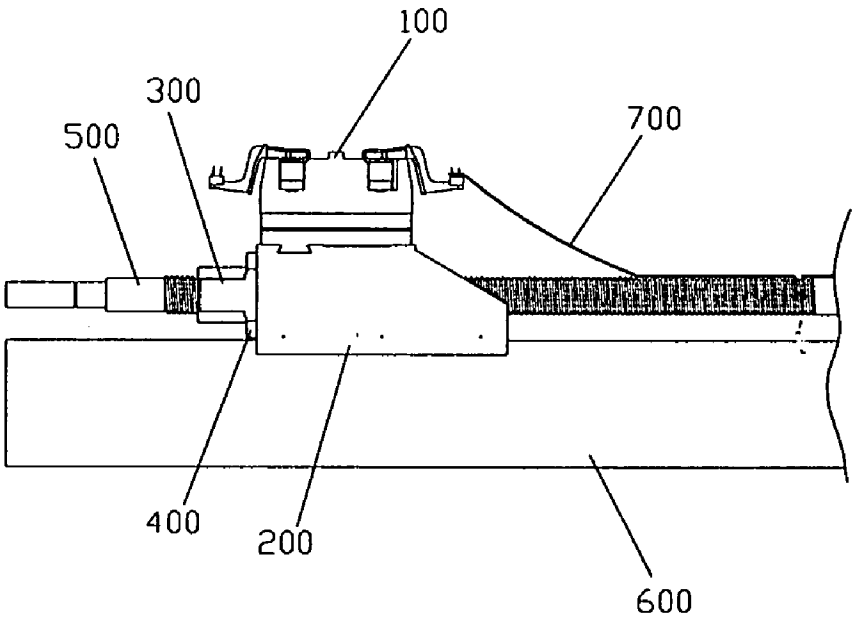
PRIOR ART FIG. 3B
FIG. 3B is a side view of FIG. 3A.
Figure 3A:
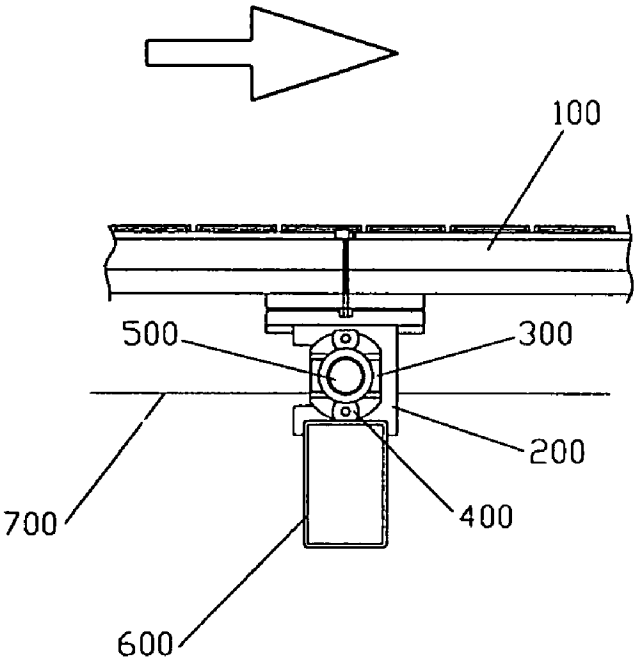
PRIOR ART FIG. 3A
FIG. 3A is a sectional view of the prior art.
Figure 4:
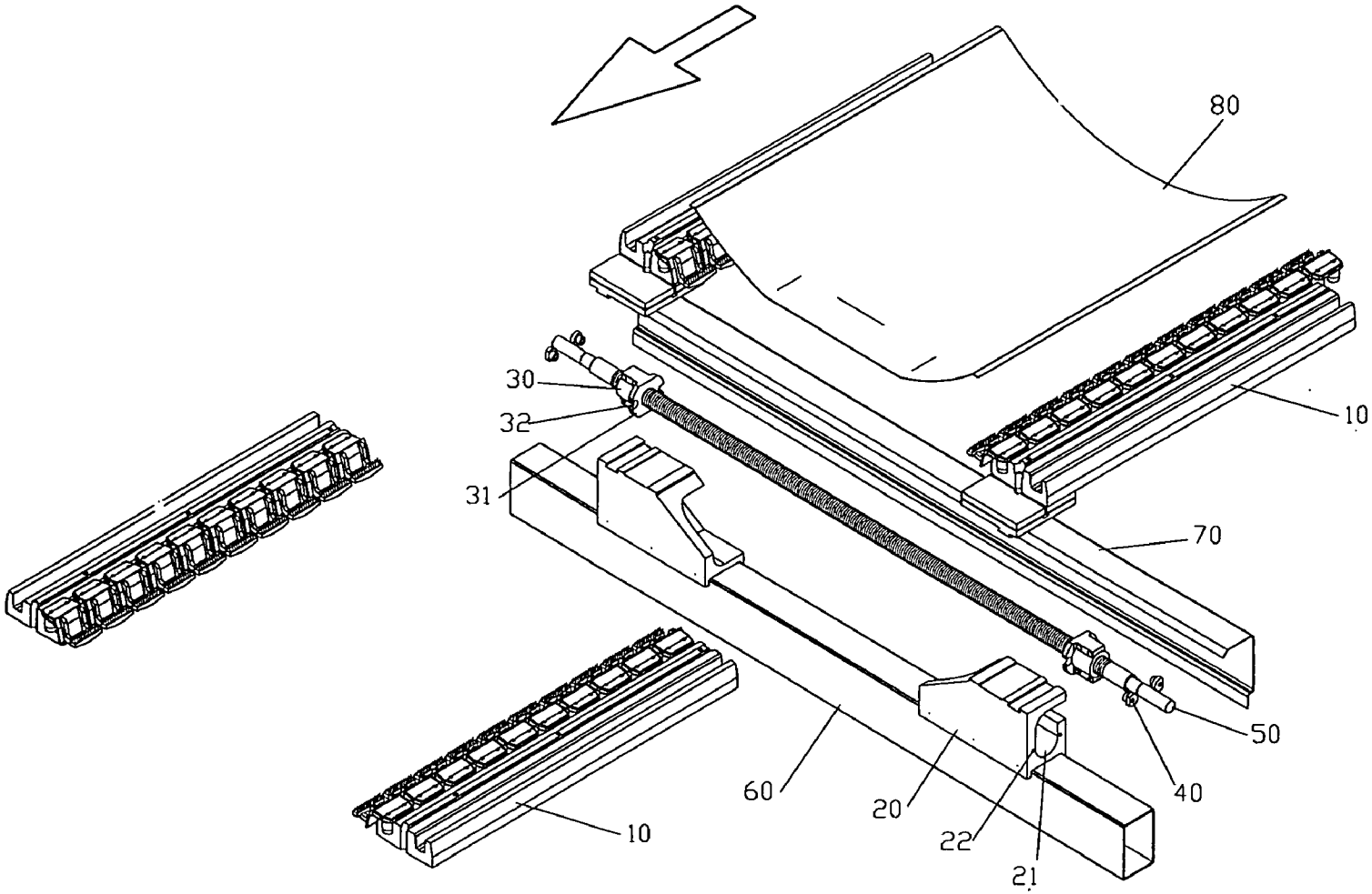
FIG. 4 is an exploded view of the present invention.
Figure 5:
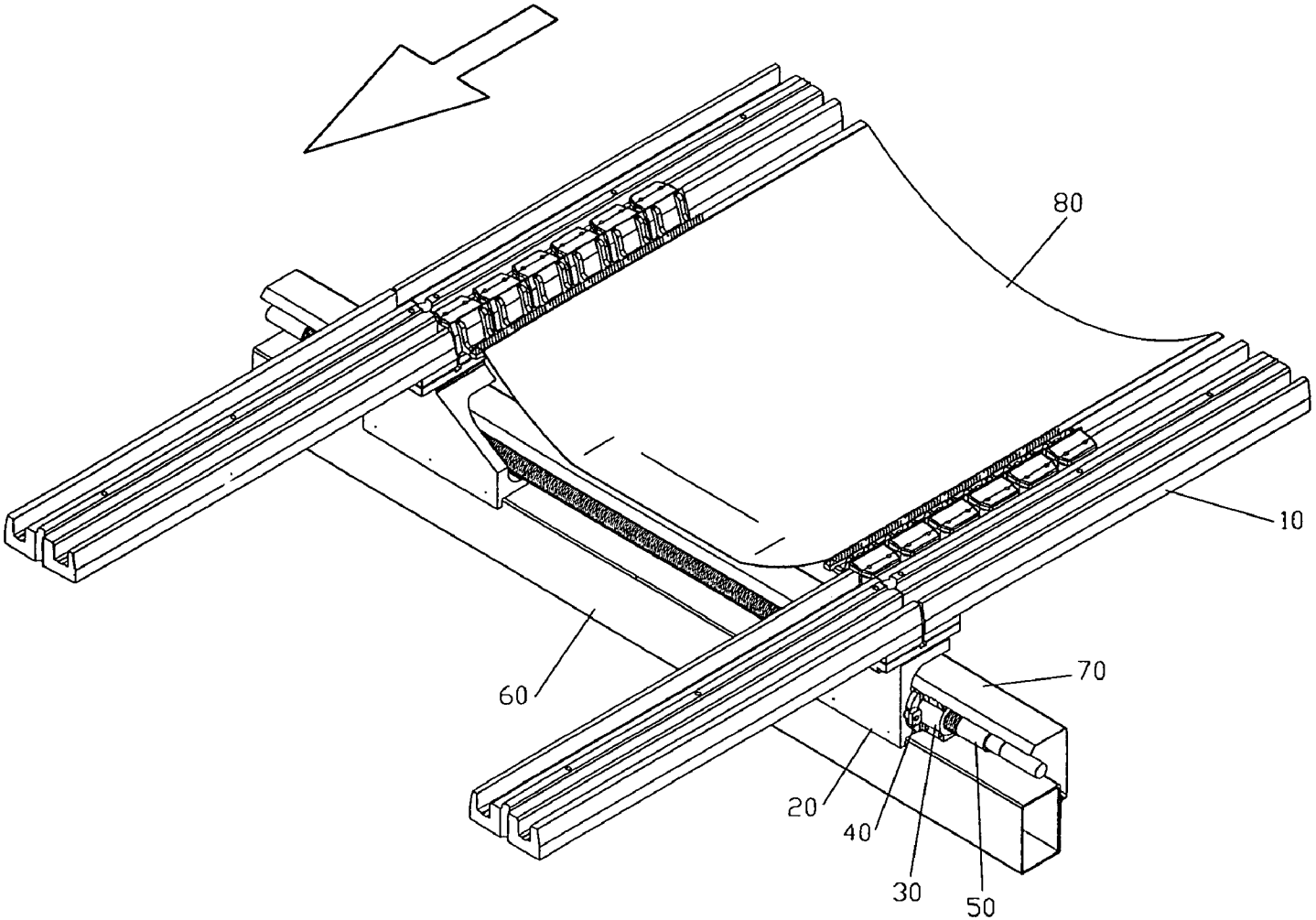
FIG. 5 is a schematic view of the present invention as assembled.

Referring to FIGS. 4 and 5, a preferred embodiment of the present prevention is essentially comprised of a fabric conveying guide rail 10, a saddle 20, a setting nut 30, a locking sleeve 40, a guide screw 50, a structured square tube 60 and a separation plate 70. The saddle 20 is locked to the lower edge of the guide rail 50. The setting nut 30 and the guide screw 10 are mounted to the side of the saddle.

The saddle 20 is made into a G-shaped block provided with a recess 21 to the web of the saddle 20. A screw hole 22 is each drilled horizontally on both outer walls of the recess 21. Multiple tabs 30 and slots 32 are provided to both sides of the setting nut 30 to hold the sleeve 40 in position to lock to the saddle 20. The guide screw 50 is threaded in the setting nut 30 and two saddles 20 are mounted in symmetry onto the laterally structured square tube 60. The elevated saddle 20 with its recess 21 allows the lateral placement of the setting nut 30 to define a space between the saddle 20 and the top of the setting nut 30. The space allows the separation plate 70 to be locked with screws to the outer wall of the recess 21 of the saddle 20. Whereas a fabric 80 in the course of conveying usually will drop, it is prevented from contacting the guide screw 50 due to that the separation plate 70 forces to separate the fabric 80 from the guide screw 50 without affecting the guide screw 50 in the adjustment of the saddle and the guide rail for a proper width to drag and pull the fabric, thus to effectively eliminate the possible contamination of the fabric by the guide screw 50.

Figure 6:
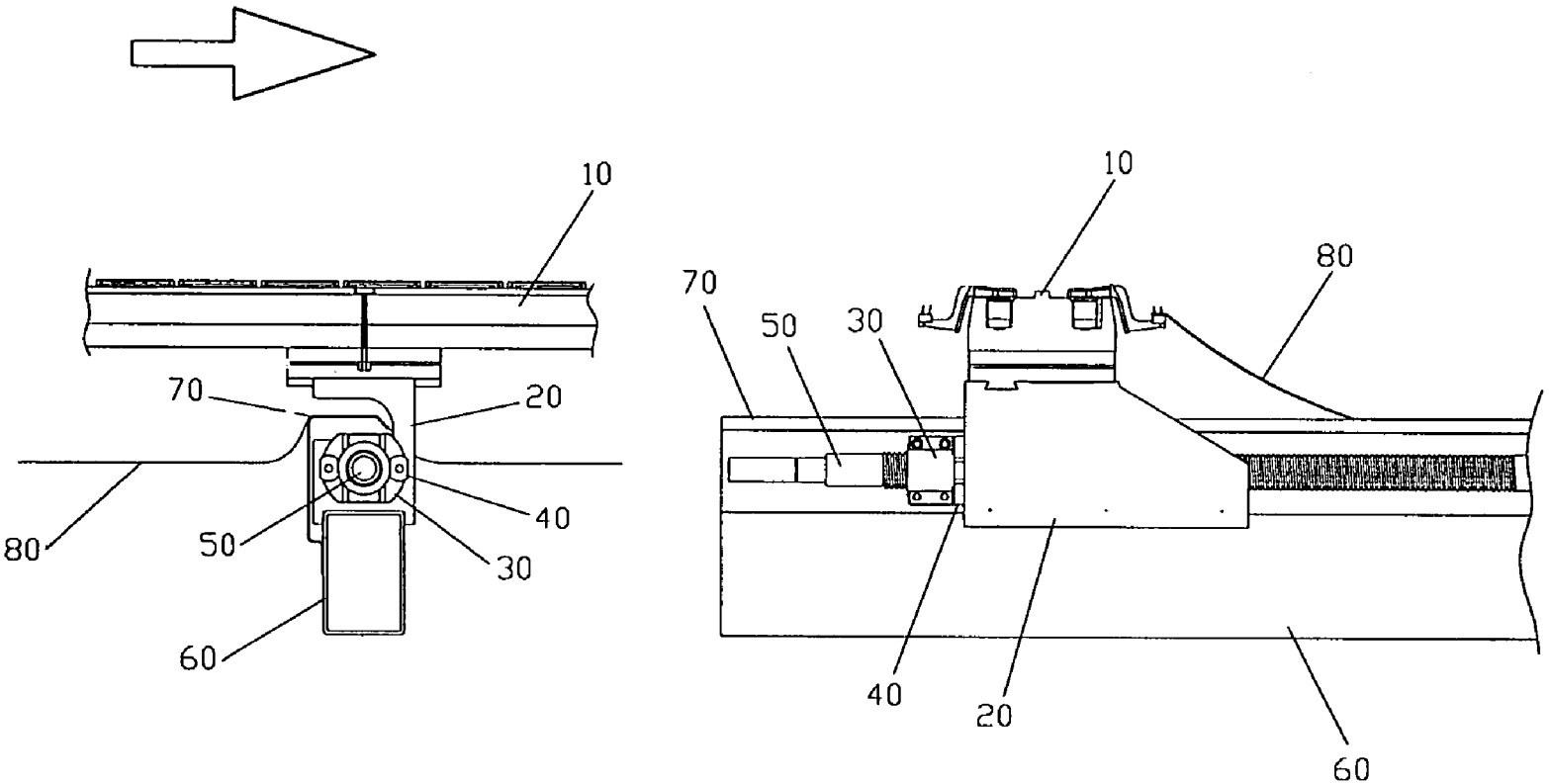
FIG. 6 is a sectional view of the present invention.

As illustrated in FIG. 6, even provided with the mobile lid in the prior art to duck away from the mobile seat, the space reserved by the recess 21 of the elevated saddle 60 allows the adjustment of the width of the guide screw 50 to move the separation plate 70 for effectively preventing the fabric 80 from being contaminated by the guide screw 50.

The guide screw 50 is provided with a left-handed thread and a right-handed thread sections. As the guide screw 50 rotates, the position of the setting nut 30 each on both sides of the structured tube 60 is changed without turning, and is axially displaced in relation to the guide screw 50. Furthermore, when the setting nut 30 pushes the saddles 20, the width of the guide rail 10 is adjusted depending on the width of the fabric to drag and pull the fabric by its edges for the dyeing and bleaching process.

In the improved structure of the fabric conveying guide rail of the present invention, two G-shaped saddles are provided, the orientation to place the setting screw is changed to horizontal direction from the vertical direction as found with the prior art, and extra height is given to saddle to define the space between the saddle and the top of the setting screw for the insertion of the separation plate to force separating the fabric from contacting the guide screw, thus to effectively prevent the fabric from being contaminated by the guide screw. The dialing plate to flap out the mobile lid taught by the citation is eliminated to save the inconvenient adjustment of the width of the guide rails by the LH and RH threaded sections of the guide screw from the mobile seat. Accordingly, the present invention meets the requirements of a utility patent. However, it is to be noted that the preferred embodiment described is not to limit the scope of the present invention, and that any equivalent modification or change to those claimed in the claim shall be deemed as falling within the scope of the pending patent of the present invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a fabric conveying guide rail to prevent the fabric from being contaminated by a guide screw is essentially comprised of a guide rail, a saddle, a setting nut, a locking sleeve, a guide screw, a structured square tube, and a separation plate; the saddle being located to the lower edge of the guide rail, the setting nut and the guide screw being placed from the side of the saddle; the saddle being made in a G-shape and a recess being reserved to a web of the saddle; a screw hole being each horizontally drilled on both sides of the outer wall of the recess; the locking sleeve being held in position by multiple tabs and slots provided to both sides of the setting nut; the saddle being locked up by the locking sleeve; the guide screw including right-handed thread and left-handed thread sections being mounted in the setting nut; two saddles being mounted in symmetry onto the structured square tube; the setting nut being locked horizontally to the recess of the saddle; a space being defined between the saddle and the top of the setting nut; a separation plate being locked to the outer wall of the saddle; and the separation plate being moved to force separating the fabric from contacting the guide screw; and the space allowing the guide screw to adjust the width between two guide rails.

* * * * *